US011492987B2

(12) United States Patent
Chen et al.

(10) Patent No.: US 11,492,987 B2
(45) Date of Patent: *Nov. 8, 2022

(54) CYLINDER CHARGE TRAPPING STRATEGIES BASED ON PREDICTIVE NUMBER OF SKIPS AND STAGGERED IMPLEMENTATION OF VALVETRAIN DEPENDENT OPERATIONAL STRATEGIES FOR INTERNAL COMBUSTION ENGINES

(71) Applicant: Tula Technology, Inc., San Jose, CA (US)

(72) Inventors: Shikui Kevin Chen, Leander, TX (US); Louis J. Serrano, Los Gatos, CA (US); Vijay Srinivasan, Farmington Hills, MI (US); Elliott A. Ortiz-Soto, San Jose, CA (US); Matthew A. Younkins, Campbell, CA (US)

(73) Assignee: Tula Technology, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/725,125

(22) Filed: Apr. 20, 2022

(65) Prior Publication Data

US 2022/0252017 A1 Aug. 11, 2022

Related U.S. Application Data

(63) Continuation of application No. 17/314,309, filed on May 7, 2021, now Pat. No. 11,352,967.
(Continued)

(51) Int. Cl.

| | |
|---|---|
| ***F02D 41/06*** | (2006.01) |
| ***F02D 41/00*** | (2006.01) |
| ***F01L 9/16*** | (2021.01) |

(52) U.S. Cl.
CPC ..... *F02D 41/0082* (2013.01); *F01L 9/16* (2021.01); *F02D 41/064* (2013.01);
(Continued)

(58) Field of Classification Search
CPC ..... F02D 41/0082; F02D 41/064; F02D 41/3058; F02D 2200/023; F02D 2200/024;
(Continued)

(56) References Cited

U.S. PATENT DOCUMENTS

| | | | |
|---|---|---|---|
| 7,577,511 | B1 | 8/2009 | Tripathi et al. |
| 7,849,835 | B2 | 12/2010 | Tripathi et al. |

(Continued)

FOREIGN PATENT DOCUMENTS

| | | |
|---|---|---|
| KR | 10-2015-0143312 | 12/2015 |
| WO | WO 2010/006311 | 1/2010 |
| WO | WO 2011/085383 | 7/2011 |

OTHER PUBLICATIONS

International Search Report and Written Opinion dated Sep. 2, 2021 from International Application No. PCT/US2021/031920.

*Primary Examiner* — Hai H Huynh
(74) *Attorney, Agent, or Firm* — Beyer Law Group LLP

(57) ABSTRACT

A system and method for controlling an internal combustion engine involving (1) cylinder trapping strategies where one of several pneumatic spring types are dynamically selected for cylinders based at least partially on a predicted number of upcoming skips for each of the cylinders respectively and/or (2) staggering various valvetrain dependent operational engine strategies as operating conditions permit as the internal combustion engine warms up following a cold start.

19 Claims, 4 Drawing Sheets

Related U.S. Application Data

(60) Provisional application No. 63/052,069, filed on Jul. 15, 2020.

(52) U.S. Cl.
CPC .. *F02D 2200/023* (2013.01); *F02D 2200/024* (2013.01); *F02D 2200/101* (2013.01); *F02D 2200/50* (2013.01)

(58) Field of Classification Search
CPC .. F02D 2200/101; F02D 2200/50; F01L 9/16; F01L 13/0005; F01L 2013/001
USPC ..... 123/198 F, 90.15, 568.11, 568.14; 701/103, 110
See application file for complete search history.

(56) References Cited

U.S. PATENT DOCUMENTS

| | | | |
|---|---|---|---|
| 7,886,715 | B2 | 2/2011 | Tripathi et al. |
| 7,954,474 | B2 | 6/2011 | Tripathi et al. |
| 8,099,224 | B2 | 1/2012 | Tripathi et al. |
| 8,131,445 | B2 | 3/2012 | Tripathi et al. |
| 8,131,447 | B2 | 3/2012 | Tripathi et al. |
| 8,464,690 | B2 | 6/2013 | Yuille et al. |
| 8,616,181 | B2 | 12/2013 | Sahandiesfanjani et al. |
| 8,651,091 | B2 | 2/2014 | Tripathi et al. |
| 8,839,766 | B2 | 9/2014 | Serrano |
| 8,869,773 | B2 | 10/2014 | Tripathi et al. |
| 9,020,735 | B2 | 4/2015 | Tripathi et al. |
| 9,086,020 | B2 | 7/2015 | Tripathi et al. |
| 9,120,478 | B2 | 9/2015 | Carlson et al. |
| 9,175,613 | B2 | 11/2015 | Parsels et al. |
| 9,200,575 | B2 | 12/2015 | Shost |
| 9,200,587 | B2 | 12/2015 | Serrano |
| 9,291,106 | B2 | 3/2016 | Switkes et al. |
| 9,387,849 | B2 | 7/2016 | Soliman et al. |
| 9,399,964 | B2 | 7/2016 | Younkins et al. |
| 9,512,794 | B2 | 12/2016 | Serrano et al. |
| 9,689,327 | B2 | 6/2017 | Younkins et al. |
| 9,790,881 | B2 | 10/2017 | Kopecek et al. |
| 10,247,072 | B2 | 4/2019 | Younkins et al. |
| 10,619,584 | B2 | 4/2020 | Fuschetto et al. |
| 2013/0298870 | A1 | 11/2013 | Tripathi et al. |
| 2014/0100739 | A1 | 4/2014 | Lee |
| 2016/0222899 | A1 | 8/2016 | Glugla |
| 2017/0030278 | A1 | 2/2017 | Phillips |
| 2017/0370308 | A1 | 12/2017 | Hashemi et al. |
| 2022/0018296 | A1 | 1/2022 | Chen et al. |

CYLINDER CHARGE TRAPPING STRATEGIES BASED ON PREDICTIVE NUMBER OF SKIPS AND STAGGERED IMPLEMENTATION OF VALVETRAIN DEPENDENT OPERATIONAL STRATEGIES FOR INTERNAL COMBUSTION ENGINES

CROSS-REFERENCE TO RELATED APPLICATIONS

This application is a Continuation of U.S. application Ser. No. 17/314,309, filed May 7, 2021, which claims priority of U.S. Provisional Application No. 63/052,069, filed Jul. 15, 2020, both of which are incorporated by reference herein for all purposes.

FIELD OF THE INVENTION

The present invention relates to internal combustion engines where some firing opportunities are fired and others are skipped, and more specifically, to (1) cylinder trapping strategies where one of several pneumatic spring types are dynamically selected based at least partially on a predicted number of upcoming successive skips and/or (2) staggering various valvetrain dependent operational engine strategies as engine parameters permit following a cold start of the engine.

BACKGROUND

Most vehicles in operation today are powered by internal combustion engines (ICEs). Under normal driving conditions, the torque generated by an engine needs to vary over a wide range in order to meet the demands of the driver. In situations when full torque is not needed, the fuel efficiency of many types of internal combustion engines can be substantially improved by varying the displacement of the engine. With dynamic displacement, the engine can generate full displacement when needed, but otherwise operates at a smaller effective displacement when full torque is not required, resulting in improved fuel efficiency.

Conventional variable displacement engines involve deactivating a group of one or more cylinders. For example, with a six-cylinder engine, a group of two, three, or four cylinders may be deactivated. Such firing patterns are often referred to as non-rotating firing pattern, meaning the same group of cylinders is fired and the same group of cylinders is skipped indefinitely until the effective displacement of the engine changes.

Another engine control approach that varies the effective displacement of an engine is referred to as skip fire engine control. With skip fire engine control, one of multiple fixed firing fractions, each indicative of a reduced effective displacement of the engine, is selected as needed to meet a requested torque demand. As the torque demand changes, the engine transitions from one fixed firing fraction to a target firing fraction suitable for the requested torque.

Operating skipped cylinders as one of several types of pneumatic springs is known. Such pneumatic springs include Low Pressure Exhaust Springs (LPES), High Pressure Exhaust Springs (HPES) and Air Springs (AS). In general, pneumatic springs offer the advantages of improved Noise, Vibration and Harshness (NVH), improved aftertreatment system efficacy, and/or improved fuel economy as compared to leaving one or both of the intake and exhaust valves open during a skipped working cycle. Each type of spring, however, has its disadvantages. While all three types of pneumatic springs are known, current ICEs are usually limited to using just one type. For instance, one ICE may use only AS type pneumatic springs, while another ICE may use only LPES type pneumatic springs.

During operation of an internal combustion engine, it may be advantageous to implement any of a number of valvetrain dependent operational strategies. Some of these valvetrain dependent strategies, however, may not be enabled immediately following a cold start. Certain engine parameters, such oil pressure, oil temperature and oil viscosity, coolant temperature, and battery voltage, all may influence how fast individual intake and exhaust valves can be activated or deactivated by the valvetrain. If the engine is cold, then the valvetrain may not be able to open and close input and exhaust valves fast enough to meet the stringent timing requirements that may be needed for some or all of the above listed strategies.

The current approach in dealing with a cold start is often to simply delay implementation of many valvetrain dependent operational strategies until the ICE has warmed up and reached its steady state operating temperature and the valvetrain hardware is capable of activating/deactivating valves fast enough to meet the most stringent timing requirements. By waiting for the most stringent conditions to be met, however, certain strategies having less stringent requirements may be unnecessarily delayed.

SUMMARY OF THE INVENTION

The present invention is directed to (1) cylinder trapping strategies in which one of several pneumatic spring types are dynamically selected based at least partially on a predicted number of upcoming skips for each of the cylinders respectively and/or (2) staggering various valvetrain dependent operational engine strategies as conditions permit following a cold start of the engine.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

Figure 1:
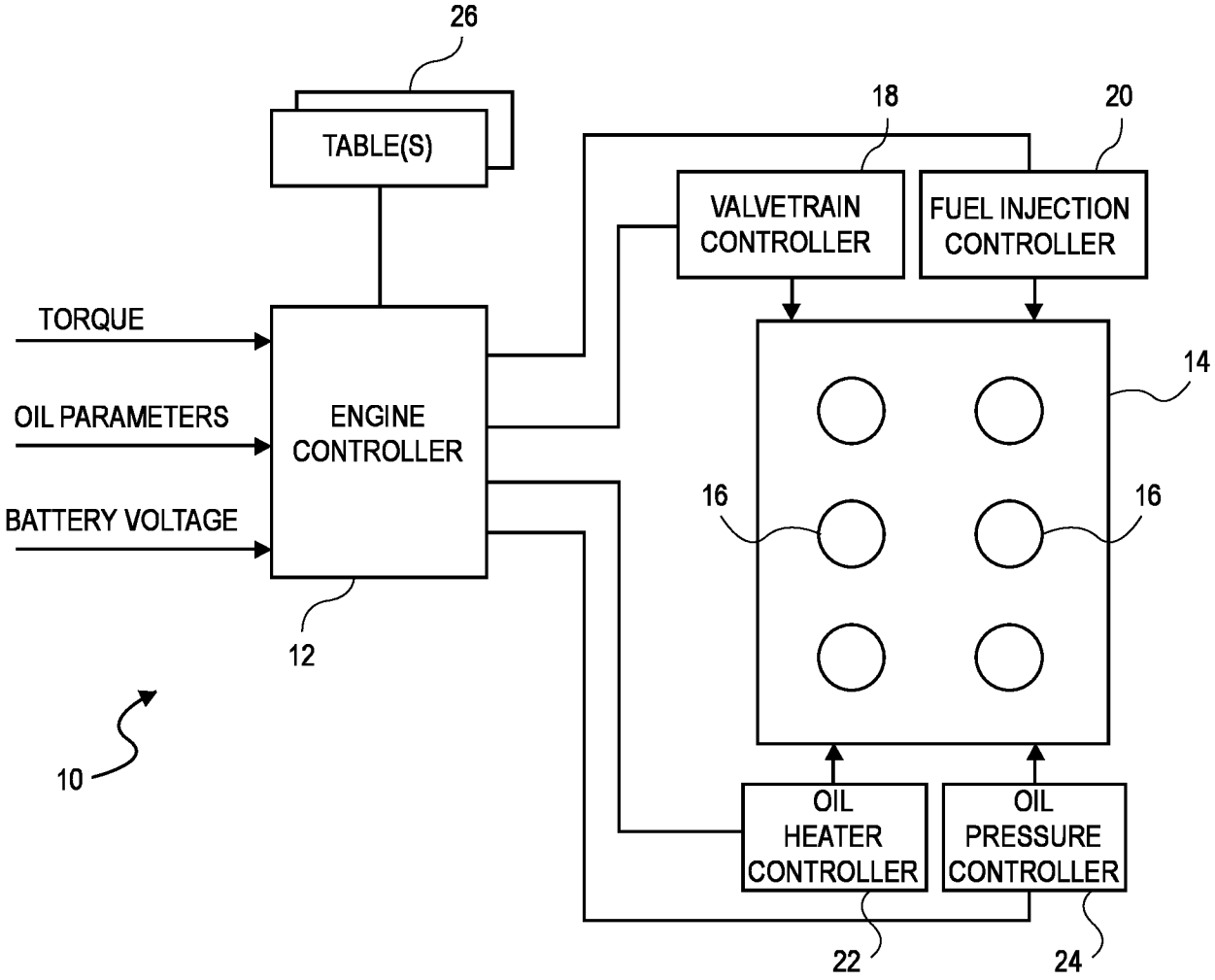
FIG. 1 is a logic diagram of an engine controller in accordance with a non-exclusive embodiment of the invention.

The Applicant has previously filed U.S. application Ser. No. 14/743,581 (TULAP038A) on Jun. 18, 2015 (Now U.S.

Pat. No. 9,387,849), which is directed to implementing skip fire engine control upon engine start and U.S. application Ser. No. 15/982,406 filed May 17, 2018 (TULAP064) (now U.S. Pat. No. 10,619,584), which is directed to changing the timing of cylinder intake and exhaust events to form different types of pneumatic springs, such as Low Pressure Exhaust Springs (LPES), High Pressure Exhaust Springs (HPES) and/or Air Spring (AS) for deactivated or skipped cylinders during skip fire engine operation. Each of the above-listed applications is incorporated by reference herein for all purposes.

The present invention is applicable to an internal combustion engine (ICE) where some firing opportunities are fired and others are skipped. Such engines, for example, may be skip fire or dynamic skip fire controlled engines using either spark ignition or compression ignition. Regardless of the engine type, the present invention is generally related to (1) cylinder trapping strategies where one of several pneumatic spring types is dynamically selected based at least partially on a predicted number of upcoming skips for each of the cylinders respectively and/or (2) staggering various valvetrain dependent operational strategies as conditions permit following a cold start.

Spark Ignition Engines

Spark ignition engines, which typically operate on gasoline, require a spark to initiate combustion. Spark ignition engines are generally operated with a stoichiometric air-fuel ratio and the mass air charge (MAC) provided to a cylinder controls its torque output. The mass air charge is generally controlled using a throttle to adjust the intake manifold absolute pressure (MAP).

Compression Ignition Engines

With compression ignition engines, which typically operate with Diesel fuel, combustion is initiated by a temperature increase associated with compressing a charge within the cylinder chamber. Compression ignition engines primarily control cylinder work or torque output by controlling the amount of fuel injected (hence changing the air-fuel stoichiometry) and/or throttling the air charge to obtain an appropriate or desired air fuel ratio. The air fuel ratio for compression engines is typically larger than stoichiometric. For example, a Diesel engine may typically operate with air-fuel ratios of approximately 20 to 160 compared to a stoichiometric air-fuel ratio of approximately 14.5. Compression ignition engines may be further classified as stratified charge compression ignition engines (e.g., most conventional Diesel engines, and abbreviated as SCCI), premixed charge compression ignition (PCCI), reactivity controlled compression ignition (RCCI), gasoline compression ignition engines (GCI or GCIE), and gasoline homogeneous charge compression ignition (HCCI).

Skip Fire Engine Control

In general, skip fire engine control facilitates finer control of the effective engine displacement than is possible with the conventional variable displacement approach. For example, firing every third cylinder in a 4-cylinder engine would provide an effective displacement of $1/3^{rd}$ of the full engine displacement, which is a fractional displacement that is not obtainable by simply deactivating a group of cylinders. With a firing fraction of 1/3 for instance, every third firing opportunity is fired, while the intervening two firing opportunities are skipped. As a result over at least three engine cycles, at least one cylinder is fired in a first firing opportunity, skipped during the next firing opportunity, and either skipped or fired during the next firing opportunity. Conceptually, virtually any effective displacement can be obtained using skip fire control, although in practice most implementations restrict operation to a set of available firing fractions, sequences or patterns. In contrast with a conventional variable displacement engine, the sequence of specific cylinder firings may vary over sequential engine cycles even though the engine is operating at the same displacement, $1/3^{rd}$ in this example. By contrast, with a conventional variable displacement eight-cylinder engine operating at half displacement for example, the same four cylinders are continually fired, while the remaining four cylinders are continually skipped over multiple engine cycles.

The Applicant has filed a number of patents describing various approaches to skip fire control. By way of example, U.S. Pat. Nos. 7,849,835; 7,886,715; 7,954,474; 8,099,224; 8,131,445; 8,131,447; 8,464,690; 8,616,181; 8,651,091; 8,839,766; 8,869,773; 9,020,735: 9,086,020; 9,120,478; 9,175,613; 9,200,575; 9,200,587; 9,291,106; 9,399,964; 9,689,327; 9,512,794; and 10,247,072 each describe a variety of engine controllers that make it practical to operate a wide variety of internal combustion engines in a skip fire operational mode. Each of these patents is incorporated herein by reference.

Dynamic Skip Fire Engine Control

Many of the above listed patents relate to dynamic skip fire control in which firing decisions regarding whether to skip or fire a particular cylinder during a particular working cycle are dynamically made. In one variation of dynamic skip fire engine control, the fire/skip decision for a given cylinder is made on an individual cylinder firing opportunity-by-firing opportunity basis. In another variation of dynamic skip fire engine control, the skip/fire decision is made on an engine cycle-by-engine cycle basis.

Cylinders, Valvetrains and Working Cycles

Cylinders typically include a combustion chamber, a reciprocating piston that defines one side of the combustion chamber, at least one intake valve and at least one exhaust valve. Most modern ICEs now include two intake and two exhaust valves. The valvetrain of the ICE is responsible for controlling the timing of the opening and closing of the valves during the working cycles of the cylinders. Valvetrains can be cam-actuated, electronic, hydraulic, pneumatic, or combinations of these types.

With a four-stroke ICE, each cylinder executes a four-stroke sequence every working cycle. The four strokes include induction, compression, combustion (sometimes referred to as expansion) and exhaust. The four strokes for a firing cylinder are described in more detail below.

In the induction stroke, the piston moves from Top Dead Center (TDC) to Bottom Dead Center (BDC) within the cylinder as the intake valve(s) is/are moved to an open position by the valvetrain. As a result, air is sucked or inducted into the combustion chamber from an intake air manifold through the open intake valve(s). Particularly for a spark ignition engine, a fuel injector may inject fuel into the chamber as well during the induction stroke. Together, the air and fuel mixture create an air-fuel charge in the chamber.

In the compression stroke, the intake valve(s) is/are closed and the piston moves from BDC to TDC, compressing the air-fuel charge within the chamber. With spark-ignition engines, a spark is used to ignite the air-fuel charge. The timing of the spark is typically before the piston reaches the TDC position as the compression stroke completes. With compression-ignition engines, there is no spark. Instead, a combination of high pressure and high temperature created within the combustion chamber as the piston moves toward and approaches TDC initiates combustion. In a compression ignition engine, some or all of the fuel injection may occur during the compression stroke. With either type of engine, combustion is usually initiated before the piston reaches the TDC position, completing the compression stroke. However, with certain Diesel engines, combustion may not always be initiated before completing the compression stroke. In many cases, it is desirable to initiate combustion after TDC for the purpose of reducing NOx emissions.

In the expansion stroke combustion may be completed. The energy released by combustion causes the piston to move from TDC to BDC, resulting in the generation of useful work (i.e., a torque output) by the cylinder.

Finally, in the exhaust stroke, the exhaust valve(s) is/are opened and the piston moves from BDC to TDC, forcing or exhausting the combusted gases into an exhaust manifold, which is typically fluidly coupled to an aftertreatment system(s).

The working cycle is complete when the exhaust valve(s) is/are closed and the piston is again positioned at the TDC. The above process is then repeated for the next working cycles of the cylinder.

Engine Cycles

During a given engine cycle of an ICE, the working cycles of the cylinders are sequenced in order. When the ICE is operating at full displacement (i.e., a firing fraction of 1), all the cylinders are fired in their sequence order. On the other hand when operating at a firing fraction less than 1, one or more of the cylinders is not fired (i.e., skipped) during a given engine cycle. The cylinders of skipped working cycles have the same reciprocating motion of the piston as a firing cylinder, but no fuel is combusted. As described below, the cylinders of skipped working cycles may be operated as one of several different types of pneumatic springs.

Pneumatic Spring Types

Pneumatic spring types including AS, LPES and HPES, may each be implemented during skipped working cycles. With each spring type, the valvetrain is responsible for timing of the opening and/or closing of intake and/or exhaust valves as needed.

Air Springs (AS)

With AS type pneumatic springs, in the intake stroke, the intake valve(s) of the cylinder is opened and air is inducted as it would be on a fired working cycle. In the compression stroke, the inducted air is then compressed. In the expansion stroke there is no fuel, so there is no combustion. In the exhaust stroke, the exhaust valve(s) is/are maintained closed so that the air is not exhausted. One disadvantage of AS pneumatic springs is that a portion of the fresh charge can escape past the piston rings into the crankcase, which creates inefficiencies and yields a lower peak in-cylinder pressure. As a result, upon the re-firing of the cylinder, late and/or unstable combustion, or potentially a misfire, may occur after multiple consecutive skip events without re-exhaust/re-intake prior to re-firing. One possible solution to avoid the above-listed issues is to exhaust the air spring by reactivating through the engine valves at the appropriate time, and inducting a new intake charge of known composition and characteristics. However, for rotating patterns, re-exhaust and re-intake is preferably avoided to prevent pumping losses and to prevent unwanted cooling of the exhaust flow, which is particularly problematic for diesel engines. For fixed patterns, re-exhaust/re-intake prior to re-firing is generally more tolerable mainly due to the relative infrequent occurrence of such events.

A variant of AS, referred to as AS with re-intake, fuel injection is disabled when the decision to skip is made. Intake would still occur normally, but no combustion would occur in the absence of fuel, even with spark ignition engines. The exhaust valve(s) would then be deactivated, and finally, intake also would be deactivated and the engine would run as an AS spring until the decision to reactivate is made. For reactivation, the first step would generally be to reactivate the intake valve(s) with fuel injection. This would refill the cylinder with fresh charge. Combustion then occurs as normal, regardless if spark ignited or by compression ignition, depending on the type of combustion engine. Finally, the exhaust valve would be reactivated. This strategy has the benefit of avoiding the lower combustion air charge associated with normal AS. One downside is that the pumping can be significant if the number of skipped cycles is relatively low. Another drawback is the intake valve may possibly open against the compressed air in the chamber of the cylinder, which may produce "popping" noise.

In yet another variation, referred to as AS with re-exhaust, differs from the other AS variations in that when the decision is made to stop skipping and start firing again, the exhaust valve is reactivated first, followed by intake and fuel injection. Like AS with re-intake, this avoids the lower air charge and a resulting weak combustion event that would likely occur on the first reactivated cycle. Unlike AS with re-intake, AS with re-exhaust can avoid large pumping losses if the number of skipped cycles is relatively low. However, this method pumps uncombusted air into the exhaust. If only one cycle is skipped, this method essentially never deactivates the valves and a significant amount of air is pumped thru the cylinder, which may impact exhaust emission control systems.

Low Pressure Exhaust Springs (LPES)

A LPES is realized by deactivating the intake valve(s) of a cylinder during the induction stroke of a working cycle immediately following the opening of the exhaust valve(s) of the previous working cycle in which combustion occurred, exhausting the previous charge. By deactivating the intake valve(s), no air is inducted into the chamber. As a result, during the subsequent compression stroke as the piston moves from BDC to TDC, the pressure inside the chamber is relatively low because only residual combusted gas from the previous fired working cycle remains in the chamber. No fuel is injected into the chamber as well so no combustion occurs (regardless if a spark occurs or not). In the exhaust stroke, the exhaust valve(s) is/are deactivated. The residual combusted gas, therefore, remains within the chamber and is not exhausted. Since no air is inducted into the cylinder, LPES offers the advantages of low pumping losses and little to no heat lost through heat transfer to the walls of the cylinder. The main disadvantage with LPES is a very small, precise valve deactivation timing window. As a result, employing a LPES require a very fast responding valvetrain. Another potential disadvantage of a LPES is that in-cylinder pressures may be below atmospheric, which may cause oil ingress into the combustion chamber through the piston rings.

A variant on the LPES is LPES with re-exhaust. In this case, the exhaust valve is reactivated before the intake valve, which results in two exhaust strokes without an intervening induction stroke. In this reactivation strategy the exhaust valve is reactivated first, followed by the intake valve and then fuel and spark. There are several reasons for doing this. First by having a re-exhaust event, gases that have leaked into the cylinder are expelled prior to induction, making the inducted charge more similar to that of a cylinder operating without deactivation. A normally firing engine relies on valve overlap and gas flow momentum to scavenge as much exhaust residual from the cylinder as possible. This is missing from LPES without re-exhaust and will lead to lower volumetric efficiency on the first reactivated cycle. Second, in the event that combustion has occurred, perhaps mistakenly, during a skipped cycle, the re-exhaust would prevent the intake valve from opening with potentially high pressure within the combustion chamber, which would likely cause significant valve train damage. Re-exhaust could be incorporated into a safety feature that requires the exhaust valve of any cylinder to open before the intake valve is allowed to open. If the exhaust valve fails to open or is deactivated, the intake valve would automatically be deactivated. A downside of this method is that its pumping loop is larger, and thus energy efficiency is lower, than that of normal LPES if the number of skipped cycles is short. As the number of skipped cycles increases the performance of the two methods becomes essentially equivalent, since most strokes experience identical conditions.

High Pressure Exhaust Springs (HPES)

With a HPES spring, the induction, compression and expansion strokes occur as normal for a fired cylinder. In the exhaust stroke, however, the exhaust valve(s) is/are not opened. As a result, combusted exhaust gas remains trapped within the chamber. In the next working cycle, the intake valve(s) of the cylinder is/are deactivated so that no new air is inducted. Instead, the trapped exhaust gas is expanded in the intake stroke and then compressed in the compression stroke. Since there is no fresh air in the cylinder, and no fuel is typically injected, there is no combustion in the combustion stroke. Instead, the trapped exhaust gas is again expanded and compressed in the exhaust stroke by maintaining the exhaust valve(s) closed. A disadvantage of a HPES is that the trapped high pressure combusted exhaust gas can leak down quickly, resulting in higher fuel consumption compared to a LPES, due to a combination of higher heat transfer losses through the cylinder walls and a higher residual leakage of the charge via the crankcase and/or valves.

HPES with re-intake is a variation of the above-described HPES. In this strategy, when a skipping cylinder is reactivated, the intake valve is reactivated first, followed by fuel and exhaust. This is similar to the reactivation process of LPES without re-exhaust. As mentioned above, this strategy has the potential to cause valve train damage due to opening the intake valve on an in-cylinder pressure at a level near combustion peak pressure. This can be prevented with appropriate design of the intake valve and its associated valve train. By opening the intake valve on a HPES, the high pressure exhaust residual in the cylinder will blow down into the intake manifold, causing significant heating of the incoming charge and noise. Volumetric efficiency may be low on the first reactivated cycle. The intake valves, ports, and manifold would need to be designed to handle higher than usual levels of pressure and temperature. This method has very large expansion/compression losses during deactivation resulting in large negative spring mean effective pressure, and consequently low fuel efficiency if the number of skipped cycles is short. This mode of operation may be especially useful in engines where some working cycles use homogenous charge compression ignition (HCCI) or similar types of combustion strategies.

Using just one type of pneumatic spring for a given ICE thus has its drawbacks. While each type of spring has its advantages, they also have their disadvantages and complications upon reactivation. The Applicant has devised a way to advantageously and strategically use two or potentially all three types of pneumatic springs for a given ICE, where the decision on which type to use is dynamically made based on a predicted number of upcoming skips for each cylinder respectively.

Engine Controller

Referring to FIG. 1, a schematic block diagram 10 including an engine controller 12 for a representative ICE 14 with a plurality of cylinders 16 is shown. The controller 12 is arranged to receive a torque request as well as other inputs indicative of (a) oil-related parameters such as temperature, pressure and/or viscosity and (b) the voltage of the battery onboard the vehicle in which the ICE 14 is used. The diagram 10 further includes a valvetrain controller 18, a fuel injection controller 20 and an optional oil heater controller 22 and an optional oil pressure controller 24. In addition, the controller 12 may rely on one or more tables 26 for making decisions related to firing fraction decisions and/or the information for implementing the three types of pneumatic springs (and variations thereof) as described above and/or one or more valvetrain-dependent ICE related operational strategies following a cold start.

The ICE 14, in the particular embodiment illustrated, includes six cylinders 16. It should be understood, however, that in alternative embodiments the number of cylinders 16 may widely vary. For instance, the engine 12 may include 1, 2, 3, 4, 5, 6, 8 10, 12 or 16 cylinders. It should be understood that the number of cylinders listed herein are merely exemplary and the ICE may have any number of cylinders, including more or less than explicitly listed herein. The cylinders may be arranged in two banks as shown in FIG. 1 or they be arranged in a single bank or more than two banks. The ICE 14 may be able to combust any of a number of different types of fuels, such as gasoline, ethanol, diesel, compressed natural gas, methanol, or any combination thereof. In yet other embodiments, the ICE 14 may rely on spark-ignition or compression-ignition. In further embodiments, the fuel injection system (not illustrated) that is controlled by the fuel injection controller can be a direct injection system, a port injection system or both.

The ICE 14 may also be a "boosted" engine. Although not illustrated, the internal combustion engine 14 may operate in cooperation with a turbocharger, supercharger, and/or a twin charger. As is well known in the art, a turbocharger is powered by a turbine driven by exhaust gases from the engine 14, whereas a supercharger is mechanically driven by a belt connected to the crankshaft (not illustrated) of the ICE 14. A twincharger refers to an engine that has both a turbocharger and a supercharger. Regardless of which type of boosted system may be used, more air, and therefore proportionally more fuel, may be inducted into the individual cylinders 16 of the ICE 14. As a result, a boosted version of the ICE 14 is capable of generating more torque output compared to a naturally aspirated version for the same cylinder displacement. Boosted engines often operate with an intake manifold pressure above atmospheric pressure, whereas naturally aspirated engines typically operate with intake manifold pressures near or below atmospheric.

The ICE 14 may also operate in cooperation with an Exhaust Gas Recirculation (EGR) system, also not illustrated. EGR, a known emissions reduction technique, operates by recirculating a portion of the exhaust gas back into the cylinders 16 of the ICE 14. With the recirculated gas, the amount of oxygen inducted into the chambers of the cylinder 16 is reduced. The recirculated exhaust gas, which has less oxygen than fresh air, acts to absorb combustion heat and reduce peak temperatures within the cylinders 16 during combustion. As a result, less $NO_x$ is produced.

The controller 12 is arranged to receive a torque request. In situations when the torque request is sufficiently high, the controller 12 operates the ICE 14 at full displacement by commanding the valvetrain controller 18 and the fuel injection controller 20 to fuel and fire all the cylinders 16 of the ICE 14. With lower torque requests, the controller 12 preferably operates the ICE 14 at a reduced displacement using, in accordance with various embodiments, either conventional cylinder deactivation; skip fire or dynamic skip fire control. Regardless of the embodiment, some of the cylinders 16 will be fired while others are skipped. With conventional reduced displacement, one group of cylinders is fired in a fixed, non-rotating pattern, while a second group of cylinders are skipped. With skip fire or dynamic skip fire, some cylinders are fired while other cylinders are skipped; however, the fire/skip pattern can vary from engine cycle to engine cycle for the same engine displacement. With any of these embodiments, the controller 12 commands the valvetrain controller 18 and fuel injection controller 20 to fuel and fire the fired cylinders 16 and to deactivate the skipped cylinders 16. It should be appreciated that a firing fraction may be conveyed or represented in a wide variety of ways. For example, the firing fraction may take the form of a firing pattern, a firing density or any other firing sequence that involves or inherently conveys the aforementioned percentage of firings.

During operation of the ICE 14, the controller 12 also provides various commands to the valvetrain controller 18 and the fuel injection controller 20 for implementing any of the three pneumatic spring types and the above-described variations In response to such commands, the valvetrain controller 18 knows the appropriate valve timing associated with each type of pneumatic spring and variations thereof, including (a) AS, AS with re-intake and AS with re-exhaust, (b) LPES and LPES with re-exhaust and (c) HPES and HPES with re-intake. In addition, the fuel injector controller 20 knows if and when the fuel injection system should inject fuel for each of the three types of pneumatic springs and variations thereof as described above.

It should be understood that the commands described above are merely illustrative and should not be construed as limiting in any regard. On the contrary, the controller 12 may command the valvetrain controller 18 to activate the intake and exhaust valves during a working cycle of a cylinder, but command the fuel injector controller 20 to not inject fuel, so as to intentionally allow pumping of air through the engine. Alternatively, the controller 12 may command the fuel injection controller 20 to inject fuel late in the combustion stroke so as to purposely allow non-burnt hydrocarbons to be exhausted into the aftertreatment system(s) of the vehicle. These are just a few examples of different types of commands the controller 12 may instruct the controllers 18, 20 to implement.

As noted above, the one or more tables 26 may be accessed by the controller 12 for making decisions related to firing fractions, implementing any of the above described pneumatic spring types and/or implementing one or more valvetrain-dependent operational strategies for the ICE 14 following a cold start as discussed in detail below.

For example, table(s) 26 may include a wide range of permitted firing fractions indexed over a wide range of engine speeds and torque demands During operation, the controller 12 finds the appropriate firing fraction to operate the ICE 14 by indexing the table 26 based on the current torque demand and engine speed and perhaps other considerations, such as aftertreatment system temperature.

Similarly, a table 26 may include timing values for certain valvetrain-dependent operational strategies following a cold start. Initially, immediately following a cold start, the valvetrain response time may not be sufficient to meet the stringent timing requirements for implementing certain strategies that may be used to improve fuel efficiency, reduce NVH, or quickly warm up the ICE 14 and/or aftertreatment systems. Such strategies may include, but are not limited to, cylinder activation/deactivation, choice of pneumatic spring type, limitations on engine speed, etc., which all influence the required timing for activating or deactivating the intake and exhaust valves. As the ICE 14 warms up, the response time of the valvetrain will improve as the battery voltage and engine oil temperature, pressure and viscosity all gradually change from their cold state values to warm steady state values. The table(s) 26 can thus be used to provide timing information as to when the response time of the valvetrain is fast enough to individually enable each of the above-listed valvetrain dependent operational strategies respectively.

In a non-exclusive embodiment, the data tabulated in the table(s) 26 is derived from empirical data. For instance, a test vehicle, the same or similar to a vehicle using the controller 12 and ICE 14, is tested over normal operation and over multiple runs including cold starts. With each test run, data is collected over time for (a) the permitted firing fractions that work for different combinations of engine speeds and torque demands over a wide operating range for each, (b) when implementing pneumatic springs is desirable and permitted or undesirable and not permitted and (c) when the response time of the valvetrain is suitable for implementing different valvetrain dependent operational strategies following cold starts based on when the valvetrain response is fast enough to implement each strategy respectively.

Cylinder Trapping Strategies

In a non-exclusive embodiment, the controller 12 predicts for each cylinder 16 of the ICE 14 a number of upcoming successive skips. During steady state (when the firing fraction or density is constant) the prediction is relatively straightforward. Extended periods of operation at a constant firing fraction most frequently occurs during extended highway driving on level roads. Here the same firing fraction may be used for extended periods of time. Even in city driving or driving in traffic, it is common to operate at a fixed firing fraction for several seconds. By way of example, a six cylinder engine operating at 1500 rpm (revolutions per minute) has 75 total firing opportunities working cycles per second with each cylinder executing 12.5 working cycles per second. Because of overlap of working cycles of different cylinders, each cylinder has approximately 12.5 firing opportunities per second, or 75 at total of 75 working cycles per second for the six cylinder engine. Thus, during normal driving, the controller 12 can often look ahead and predict the skip fire pattern on a cylinder ten or more working cycles in the future.

During firing fraction transitions, when the firing density is changing, predicting the skip fire pattern may be a bit more involved. When a decision is made to start the transition, the future can be predicted until the target firing fraction is reached. If the starting and target firing fractions are very close (e.g., ¼ to ⅓), then typically no intermediate firing fractions are needed and the fire-skip pattern for each cylinder can be readily predicted for the entire firing fraction transition. If the firing fraction transition between the starting and target firing levels is linear, all that is needed is the rate-of-change of the firing fraction. Even if the firing fraction trajectory is more complex, the skip fire pattern can still be readily determined, for example, by using a look up table or using any other method.

If there is a wide disparity (e.g., from a low firing fraction to a large firing fraction or vice versa), then the transition may be divided up into multiple smaller transitions involving one or more intermediate firing fractions. Then, for each intermediate transition, a fire-skip pattern may be predicted for each cylinder. By determining a dwell time at each intermediate firing fraction and a transition trajectory between the firing fraction levels, the fire-skip pattern for the entire transition can be predicted for each cylinder.

Of course, the decision on the target firing fraction level can change during the transition if there is a change in torque demand. For example, an initial change from ¼ to ⅓ may be changed in mid transition into new target firing fraction of ⅔. There may be further interruptions before the firing fraction reaches ⅔ if the torque demand again changes. Once at the target firing fraction is reached, there may be additional inputs to align the skip fire pattern to the desired pattern.

Once the upcoming fire-skip pattern for each cylinder is predicted, regardless if the ICE is operating in a steady state or transitioning, the number of upcoming successive skips for each cylinder can be readily determined.

A trapping strategy involves selecting a pneumatic spring type based on a prediction of the number of upcoming successive skips for each cylinder. In a non-exclusive embodiment, an exemplary strategy is provided in Table I below.

TABLE I

| Firing Pattern | Pneumatic Spring Type |
|---|---|
| Fire-fire | None, no skipped working cycle |
| Fire-skip-fire | AS |
| Fire-skip-skip-fire | LPES |
| Fire -three to five skips - fire | HPES with LPES for the last skipped working cycle |
| Fire -six or more skips - fire | HPES |

If one skip is predicted, then an AS pneumatic spring may be used. With just one skip, the cylinder pressure and temperature is not likely to degrade significantly. As a result, unstable combustion and/or a misfire are unlikely to occur with the next fire. In addition, since the pressure within the cylinder remains relatively high and likely above atmosphere, little to no oil will likely be sucked into the chamber, minimizing the inadvertent combustion of oil.

With two predicted skips between fires, an LPES pneumatic spring may be used. LPES offers several advantages. One advantage compared to an AS is that relatively cool incoming air from the intake manifold is not inducted to the cylinder, which helps to maintain a high cylinder temperature. This feature is particularly important on diesel engines, which rely on compression heating for ignition. As a result, unstable combustion and/or misfires may occur less frequently than if two AS working cycles were used. A LPES working cycle does not pump air through the engine, which improves fuel efficiency and avoids cooling the aftertreatment system. A disadvantage of a LPES is that pressure within the cylinder may drop below atmospheric pressure, resulting in the possibility that some oil may be sucked into the chamber. However, two skip cycles may not be long enough to cause significant drop in cylinder pressure, minimizing possibility of oil ingress. In addition, the engine may operate with firing patterns having two skips between successive fires only a small portion of the time over a typical drive cycle. As a result, oil consumption may be acceptable.

With more than two predicted skips, using a HPES may beneficial because the pressure within the chamber typically remains above atmospheric pressure, preventing the sucking in of oil into the chamber and its inadvertent combustion on a subsequent fired working cycle. HPES springs, however, offer relatively poor fuel efficiency if used for only a small number of consecutive skips, since much of the energy generated in the preceding fired working cycle is dissipated as heat in the engine. In addition, if the HPES is only sustained for a few working cycles, the in-cylinder pressure may be excessively high when the intake valve opens on the fired working cycle that follows the series of HPES working cycles. This may cause mechanical damage to the valvetrain. As a result, the cylinder may have to be vented prior to a firing, by using an LPES working cycle. By using an LPES for the last skipped working cycle, the cylinder will vent in preparation for the induction stroke for the next fired working cycle. Table I shows that HPES working cycles followed by a LPES working cycle may be used when there are between three to five consecutive skipped working cycles. If there are six or more consecutive skipped working cycles, the in-cylinder pressures will have decreased to the point that the intake valve may be opened safely on the following fired working cycle.

The pneumatic spring type used for the number of skips listed in Table I are merely exemplary and should not be construed as limiting. However, the regiment, as recited in Table I, provides several benefits. First, misfires and/or poor combustion events are minimized because the use of AS springs is limited to only single skips. For two or more successive skips, LPES and/or HPES pneumatic springs are used, both of which trap hot exhaust gas in the cylinder. This reduces the risk of misfires or poor combustion for subsequent fired working cycle. With AS and HPES springs, the burning of oil is typically not an issue. With LPES type springs, while inadvertent oil consumption may be an issue, limiting use of LPES to just a few situations reduces oil consumption to an acceptable level in most situations.

In alternative embodiments, the above-described strategy can be implemented by the controller 12 by using an algorithm, models or maintaining Table I in memory accessible by the controller 12. It should be noted that the type of pneumatic spring listed for each number of skips is merely exemplary and should not be construed as limiting. In other embodiments, any one of the different pneumatic spring types may be used regardless of the number of skips.

It is further noted that other decision tables maybe used, including accounting for engine speed, engine load, exhaust temperature, or aftertreatment system temperature. Higher engine speeds limit the amount of time in which a valve can be effectively deactivated, which may impose restrictions to which spring types may be chosen. For example, at higher engine speeds, each working cycle takes a shorter amount of time and thus there is less time for a cylinder to cool during skipped firing opportunities and less time for oil in ingress into a cylinder. As such, high engine speeds may favor operating more working cycles as AS or LPES working cycles. Low exhaust or aftertreatment system temperatures may favor more LPES or AS without re-exhaust working cycles, since they vent hot exhaust gas into exhaust system without pumping air through the engine. Pumping air through the ICE 14 tends to reduce the temperature in an aftertreatment system. Alternatively, the exhaustion of non-combusted fuel into the aftertreatment system may be used to increase the temperatures of the aftertreatment system if the non-combusted fuel can oxidize in the aftertreatment system. Thus, by manipulating the intake and exhaust valves of the cylinders 16 to allow air pumping and/or allowing non-combusted fuel to be exhausted, the temperature of the aftertreatment systems can be controlled to some degree.

Flow Diagrams

Figure 2:
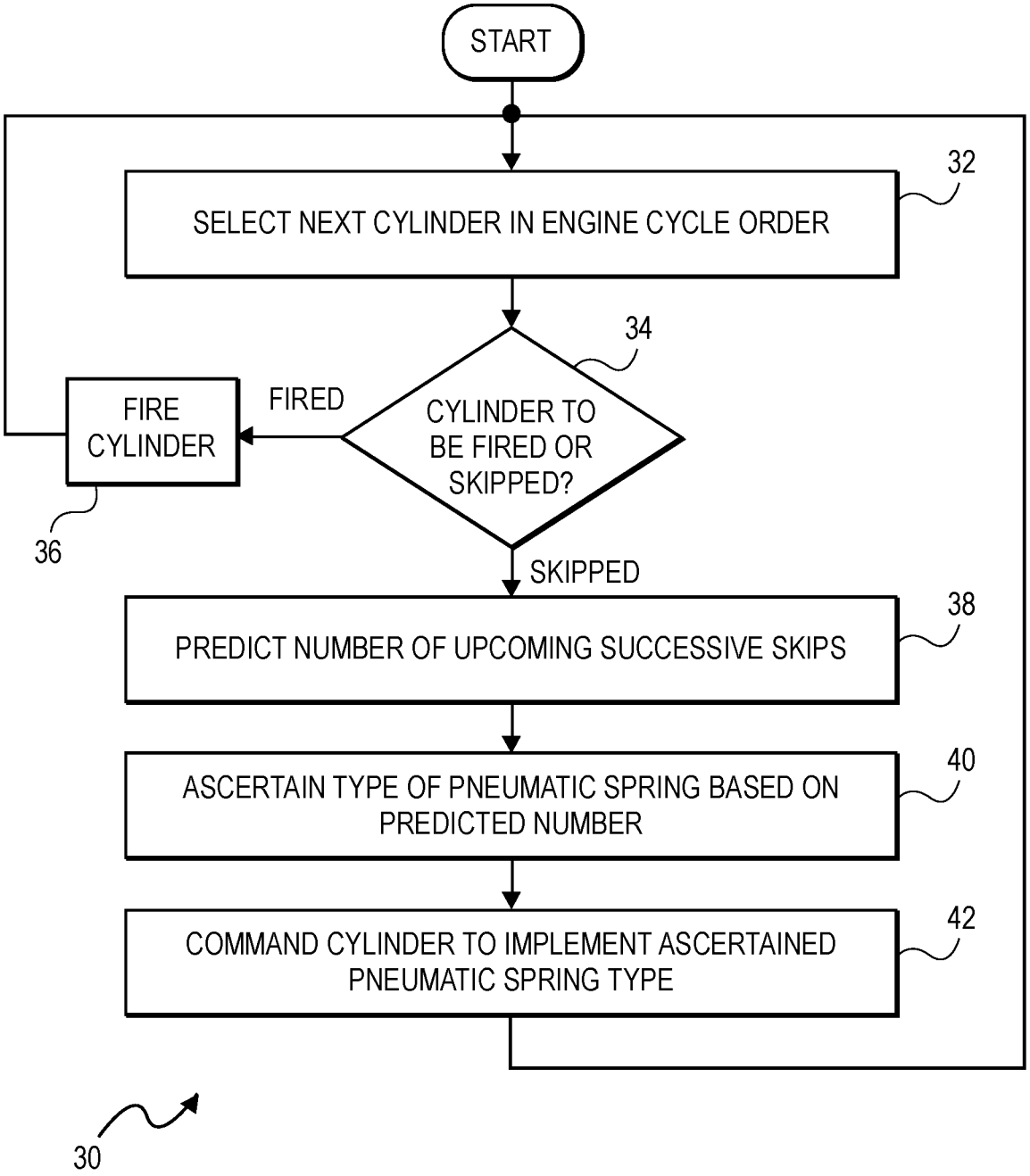
FIG. 2 is a flow diagram illustrating steps for commanding cylinders to implement one of several different types of pneumatic springs in accordance with a non-exclusive embodiment of the invention.

Referring to FIG. 2, a flow diagram 30 illustrating steps for the controller 12 to command cylinders 16 of the ICE 14 to implement one of several different types of pneumatic springs is illustrated.

In step 32, the controller 12 selects the next cylinder 16 in the engine cycle order.

In decision 34, it is determined if the next cylinder 16 is to be fired or skipped.

In step 36, the cylinder is fired if the decision was to fire. Control is then returned to step 32.

In step 38, the number of upcoming successive skips is predicted if the decision is to skip.

In step 40, the type of pneumatic spring is selected based on the predicted number of upcoming successive skips. In the non-exclusive embodiments noted above, the type of pneumatic spring is selected as articulated above with regard to Table I. In other embodiments, other factors may also be used in at least partially determining the type of pneumatic spring to use, such as cylinder load, engine speed, exhaust temperature and/or aftertreatment system(s) temperature(s).

In step 42, the controller 12 commands the valvetrain controller 18 and/or the fuel injection controller 20 to implement the selected pneumatic spring type. In response, the valvetrain controller 18 carries out the necessary steps to activate and/or deactivate the intake and/or exhaust valves as needed to implement the selected pneumatic spring type.

Following either steps 36 or 42, control is returned to step 32 and the above-described process is repeated for the next cylinder in the engine cycle order. This process is continually repeated during operation of the ICE 14.

It is noted that the above discussion, re-intake and/or re-charging strategies are not mentioned for the sake of simplicity. It should be understood, however that re-intaking and/or re-charging strategies may be selectively used for skipped cylinders operating as any of the AS, LPES or HPES type pneumatic springs as described herein. See below for an explanation of cylinder re-charging.

Firing Fraction Transitions

Figure 3:
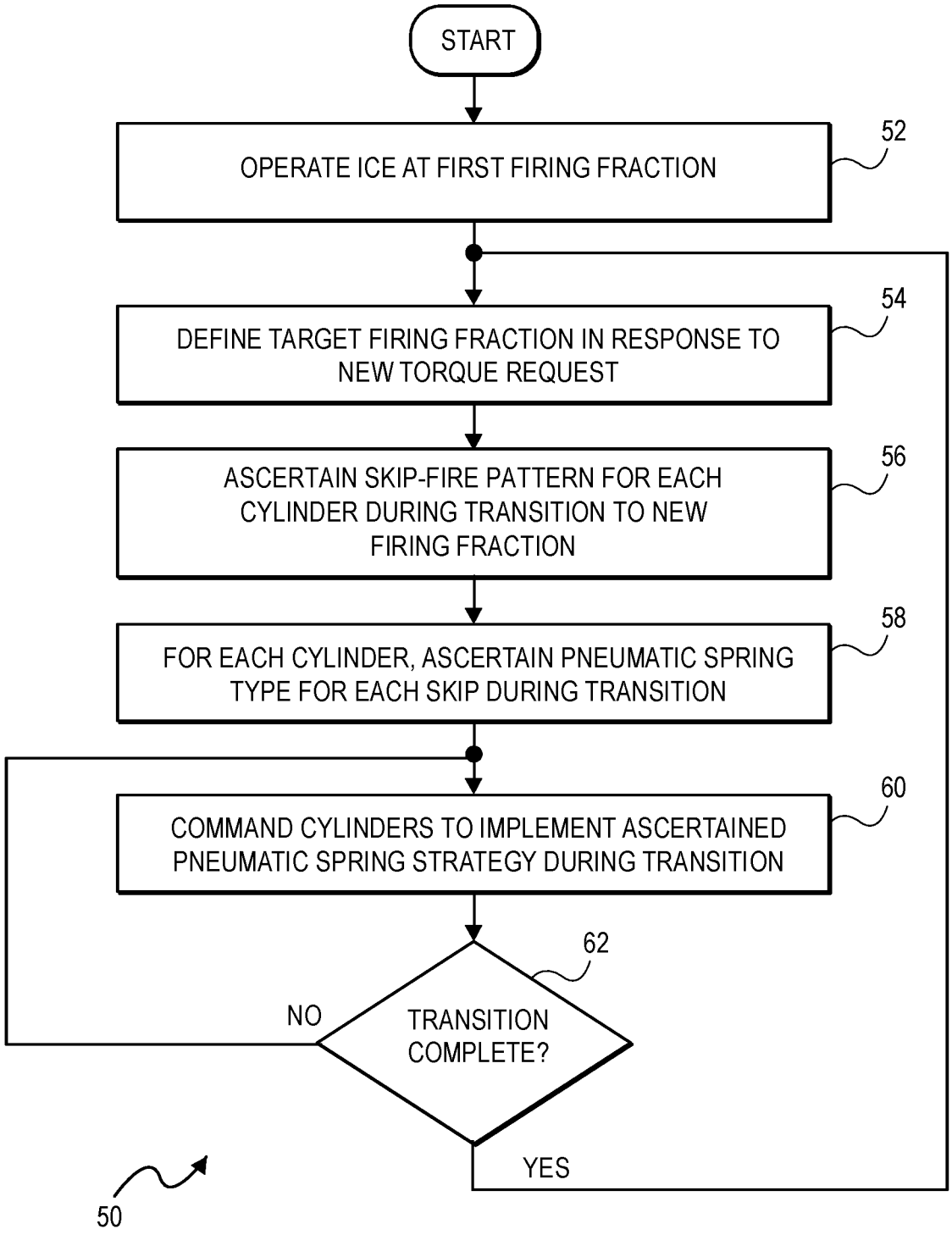
FIG. 3 is a flow diagram illustrating steps commanding cylinders to implement one of several different types of pneumatic springs during firing fraction transitions in accordance with a non-exclusive embodiment of the present invention.

Referring to FIG. 3, a flow diagram 50 illustrating steps commanding cylinders to implement one of several different types of pneumatic springs during firing fraction transitions is illustrated.

In step 52, the ICE 14 is operated at a first firing fraction.

In step 54, the controller 12 determines a target firing fraction in response to a new torque request. In non-exclusive embodiments as previously noted, the controller 12 may determine the new firing fraction by indexing the tables 26 using the requested new torque demand and engine speed.

In step 56, the skip-fire pattern for each cylinder 16 of the ICE 14 may be determined during the transition as previously described. From the skip-fire pattern for each cylinder 16, the number of upcoming successive skips can readily be determined.

In step 58, the pneumatic spring type strategy for each cylinder 16 during the transition is ascertained. As previously noted, the type of pneumatic spring selected can be AS, LPES and HPES only or LPES and HPES for one, two or more than two successive skips respectively.

It is also noted that a given cylinder 16 may possibly implement two or more different types of pneumatic spring types during a given transition. For example, a fire-skip pattern for a given cylinder 16 may involve one or more fires between multiple skips (e.g., a fire-skip pattern of fire-skip-fire-skip-skip-fire). In which case, different types of pneumatic springs can be implemented. For the exemplary pattern provided in Table I, an AS working cycle would be used if there is only a single skip between successive fired working cycles and two LPES working cycles would be used if there were two successive skips between two fired working cycles.

In step 60, the controller 12 commands the valvetrain controller 18 and or fuel injection controller 20 to implement the ascertained pneumatic spring type strategy for each cylinder.

In decision 62, the controller 12 determines if the transition to the target firing fraction is complete or not. If not, control is returned to step 60. If yes, control is returned to step 54.

When a new torque demand is made, resulting in a different firing fraction being commanded, the above process is repeated for the transition. The above process is thus continually repeated during driving as the torque demands requested of the ICE 14 change.

Cold Starts

The term "cold start" as used herein is intended to be broadly construed. The term is often used to describe a situation where a vehicle is parked for an extended period of time and the engine cools to, or close to, ambient temperature. When the engine is turned on, it is considered a "cold start" because the ambient temperature will almost always be less than the normal warm operating temperature of the engine. While such a situation is appropriately considered a "cold start", it is by no means the only situation that can be appropriately characterized as a cold start. On the contrary, any situation where a vehicle is started and either the engine and/or the aftertreatment system is/are below their normal warm operating temperature(s) is considered a cold start as well. For example, a driver may park, turn off their vehicle, and then restart the vehicle a few minutes later. During the interim, the temperature of the engine and/or the aftertreatment systems may drop below their normal warm operating temperature, but still above ambient temperature. In such a scenario, restarting the engine is considered a "cold start". In another example, a vehicle may idle for an extended period of time with the engine running. Since little demand is being placed on the engine, the temperature of the engine and/or the aftertreatment system may drop below their normal warm operating temperatures. When the vehicle begins to move again, the situation is similar to a "cold start" because either or both the engine and aftertreatment system(s) are below their normal warm operating temperature. Thus, as used herein, the term "cold start" is intended to be broadly construed to cover any situation in which the engine and/or an aftertreatment system is operated below their normal warm operating temperature(s).

Valvetrain-Dependent Cylinder Deactivation Strategies

Certain engine parameters, such as oil pressure, temperature, and viscosity, as well as possibly the battery voltage, all influence how fast the individual valves of a valvetrain can be opened or closed. If the oil is too cold, the oil pressure too low, and/or too viscous because the engine is cold, or the voltage is low because the battery is cold, then the valvetrain may not operate fast enough to meet the stringent timing requirements for certain valvetrain dependent operational strategies that require valves to be intermittently activated/deactivated. Various factors that influence what cylinder deactivation strategies may be implemented are described below.

Trapping Strategies: As noted above, it may be advantageous to operate cylinders as one of AS, LPES, or HPES type pneumatic springs. The valve timing requirements of each type of pneumatic spring, however, varies. As a general rule LPES type springs have more stringent valve timing requirements compared to AS and HPES type pneumatic springs. Therefore, the implementation of pneumatic springs can be staggered by first permitting AS and HPES springs because they have less stringent timing requirements while delaying the enabling of LPES springs which have more stringent timing requirements.

Firing Fraction Strategies: Rotating pattern firing fractions require a faster response from the valve deactivation mechanism than is required for fixed pattern firing fractions. Thus, fixed pattern firing fractions can be enabled sooner than rotating pattern firing fractions.

Slow vs. Abrupt Transitions: For a slow ramped transition, a given cylinder may have multiple switches back and forth between the cylinder deactivation and reactivation states. With abrupt transitions, however, there is just one switch between the two states. As a result, slow ramped transitions may be more challenging with low oil temps. For instance, with a 1% failure rate of cylinder deactivate/reactivate at 20 deg C., the more switches that are commanded, the higher the chances of a failure. So it may be useful to only use fixed FFs and non-ramped transitions to minimize such failed events. Even if one of the cylinders does fail to reactivate on the first attempted engine cycle, the command status doesn't switch back and forth, so it will eventually successfully actuate in the next cycle. As a consequence with abrupt transitions, cylinder failure to either deactivate or reactivate is statistically less likely, and even if a failure occurs, the consequences or minimal since the cylinder will likely successfully deactivate or activate in the next cycle. Accordingly, firing fraction strategies can be staggered by enabling fixed pattern firing fractions and abrupt firing fraction transitions sooner and delaying rotating patterns and gradual transitions until after the engine has considerably warmed up.

Engine Speeds: Successful execution of skip fire operation requires a fast-acting valve activation/deactivation mechanism. The required response time is inversely proportional to engine speed, i.e. lower engine speeds can successfully operate with a slower response time than higher engine speeds. There may be a maximum engine speed above which skip fire operation is prohibited under all engine conditions, for example, 4000 rpm. The allowed maximum engine speed for skip fire operation can vary based on various engine parameters, such as valvetrain temperature, battery voltage, oil pressure, oil temperature etc. Therefore, the allowed maximum engine speed for skip fire operation may be gradually ramped up as the engine warms up.

Cylinder Re-charging: When cylinders are skipped over one or more successive working cycles when operating in AS or HPES modes, the pressure within the chamber will often drop as trapped gas leaks through the piston seals. Depending on the pneumatic spring type being used, the in-cylinder pressure may drop below atmospheric pressure. As a result, oil may be sucked into the combustion chamber from the crankcase through the piston rings and/or through the valve assembly. Oil consumption is a source of harmful emissions and may also damage certain aftertreatment systems. Cylinder re-charging involves timing the opening and closing of the intake and exhaust valves to avoid or minimize sub-atmospheric in-cylinder pressures and hence reduce oil consumption.

Cylinder re-charging may be implemented in a number of different ways, including (i) opening and closing the intake and exhaust valves during the same working cycle (i.e., intake and exhaust in the same working cycle), (ii) opening the exhaust valve in one working cycle and then opening the intake valve in the next working cycle (i.e., exhaust without re-intake) or (iii) opening the intake valve without opening the exhaust valve (re-intake without re-exhaust). During cylinder re-charging, the intake and exhaust valves do not necessarily have to be fully opened and closed as per a typical fired working cycle. Instead in alternative embodiments, the intake and exhaust valves can be "blipped" open and closed, meaning the valve(s) is/are opened for just enough time to equalize or substantially equalize the in-cylinder pressure with the intake manifold pressure and the exhaust valve(s) are opened for just enough time to equalize the in-cylinder pressure with the exhaust manifold pressure.

Cylinder Reactivation: Cylinder reactivation is the activation of a cylinder after a skipped working cycle so that the cylinder is fired in the subsequent working cycle. When a cylinder is to be reactivated, it may often require prepping, which may involve exhausting in the previously skipped cycle as well as possibly induction and/or fueling. When a single deactivation mechanism (e.g. an oil control valve or "OCV") is used to activate and deactivate both the intake and exhaust valves of a cylinder, timing complications may result. For example, if the conditions for opening/closing the exhaust valve on the exhaust stroke are different than for opening/closing the intake valves on the induction stroke of the next working cycle, the deactivation mechanism must quickly adjust between the two events. There are typically practical limits on the timing involved. If the exhaust valves are deactivated too early, then incomplete exhausting may occur, possibly resulting in valvetrain damage during the subsequent intake stroke. If the exhaust valve deactivation is delayed on the other hand, then the timing may impede upon the subsequent induction stroke. Accordingly, the deactivation mechanism needs to adjust within a precise timing window. For instance, at an engine speed of 3000 rpms, the timing window for activation of the valves for induction is in the approximate range of 8 to 12 milliseconds. As the engine speed increases, the timing window will typically get smaller, making the timing requirements more stringent. With engines having a valvetrain with separate deactivation mechanisms for the intake and exhaust valves, these timing constraints are largely avoided.

Since the required valve response time is inversely proportional to engine speed, higher engine speeds have smaller response windows and lower engine speeds have longer response windows. Thus, the cylinder reactivation strategy employed may be dependent on the engine speed.

Staggered Example

Table II below, shows a timeline of enablement of various cylinder deactivation strategies following an engine cold start. In the left-most column, time increments (0, 30, 60, 120, 180, 240 and 300 seconds) between a cold start and the warm steady state condition of the ICE, assumed to occur at 300 seconds) are provided for each row in Table II, respectively. In subsequent columns, from left to right, trapping, cylinder recharging, reactivation, firing fraction and engine speeds strategies are provided, respectively. As the table is traversed from top to bottom, the contents of each row indicate when various strategies may be enabled. As a general rule, those strategies with less stringent valve timing requirements are enable in the upper rows while those with more stringent valvetrain timing requirements are enabled in the lower rows.

It is noted that the timeline shows the timing of when each of the various options outline in the table could be enable, not that they are in fact enabled. Table II thus defines various possible staggered sequences for implementing aspects of many of the above-defined strategies as the ICE warms up following a cold start and the timing limits that are imposed before engine conditions permit the individual aspects to be enabled. The time equals zero entry may correspond to either the initial cranking of the engine from 0 rpm or may refer to a time shortly after cranking has stopped when the engine has reached an idle speed of around 600 rpm.

It is also noted that the time periods listed in the left column are used in substitute for the actual measurements of oil pressure, temperature, and viscosity and battery voltage. Therefore, any of those parameters, such as oil temperature and/or engine coolant temperature, may be used in place of time in the left column. As an ICE operates following a cold start, the oil and battery voltage parameters will gradually reach their warm steady state operating conditions, meaning the timing capabilities of the valvetrain will gradually improve until reaching peak speed when the ICE is fully warmed up.

TABLE II

| Time (Seconds) | Pneumatic Spring Type | Cylinder Recharging Strategy | Reactivation Strategy | FF selection | Engine speed upper limit |
|---|---|---|---|---|---|
| Cold Start 0 | AS HPES | Adjacent exhaust and intake strokes have same deactivation state | Adjacent exhaust and intake strokes have same deactivation state | Fixed pattern, abrupt transitions | 600 RPM To 800 RPM |
| 30 | | | | Fixed pattern, ramp controlled transitions | 1000 RPM |
| 60 | | | | Some rotating patterns | 1500 RPM |
| 120 | LPES | Adjacent exhaust and intake strokes have different deactivation states | Adjacent exhaust and intake strokes have different deactivation state | No limitation on FF selection or transitions | 2000 RPM |
| 180 | | | | | 3000 RPM |
| 240 | | | | | 3500 RPM |
| 300 (Fully warmed up) | | | | | 4000 RPM |

The entries in Table II reflect the previous discussion. At engine turn on use of a LPES pneumatic spring type is prohibited because of the rapid switching required between a temporally adjacent exhaust stroke and intake stroke. Thus, only AS or HPES pneumatic spring types are allowed that have the same state of the deactivation mechanism (i.e. both strokes activated or deactivated), for adjacent exhaust and intake strokes. Only firing fractions having fixed firing patterns are initially allowed. The allowable engine speed for cylinder deactivation increases steadily as the engine warms up. It should be appreciated that the engine speed influences when all the different types of pneumatic springs, recharging and reactivation strategies, and firing fraction selections are allowable.

Figure 4:
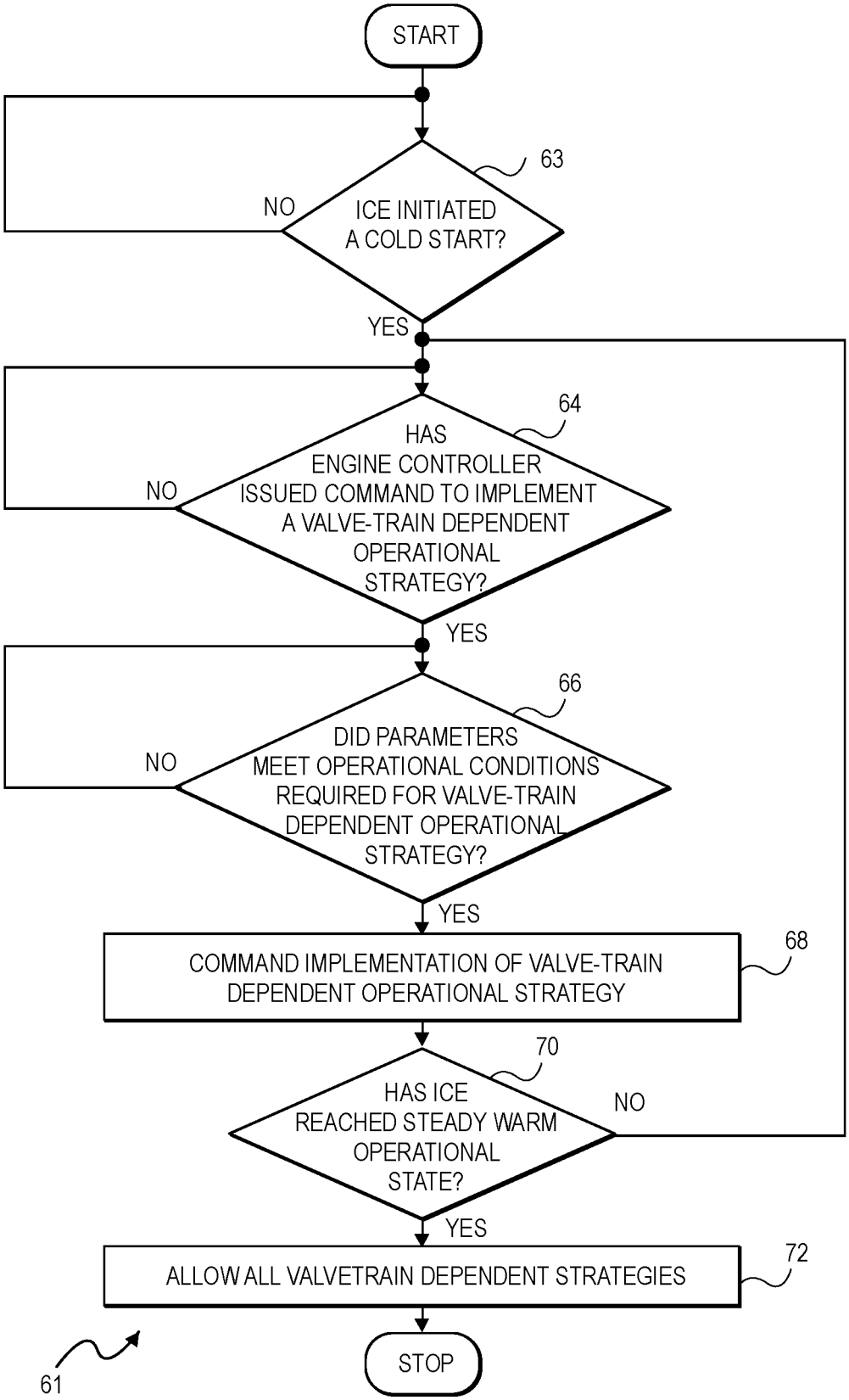
FIG. 4 is a flow diagram illustrating steps for staggering the implementation of one or more valvetrain dependent operational strategies as an engine warms up following a cold start in accordance with the present invention.

Referring to FIG. 4 a flow diagram 61 illustrating steps for staggering the implementation of one or more valvetrain dependent operational strategies as an engine warms up following a cold start is illustrated.

In the decision 63, it is determined if the ICE 14 has initiated a cold start.

In decision 64, it is determined if the controller 12 has issued a command to implement one of the above-defined valvetrain operational strategies. If not, the process waits until such a command is issued.

In decision 66, it is determined if the engine parameters (e.g., oil temperature, pressure, viscosity and/or the battery voltage) have sufficiently progressed toward their warm steady state values to enable the valvetrain to meet requisite valve opening/closing timing requirements. In one non-exclusive embodiment, the controller 12 accesses a table 26 (see FIG. 1) to make the determination if the commanded operational strategy can be enabled or not. As noted, the table(s) 26 is/are created from empirical test data that is tabulated to show timing measurements for the opening and closing of intake and exhaust valves as a test engine warms up following a cold start. In an alternative embodiment, the above listed engine parameters can be measured using sensors. In yet another embodiment, the controller 12 may use an algorithm that relies on predictive models for each parameter following a cold start. Regardless of the embodiment used, the controller 12 determines if the requested valvetrain dependent strategy can be implemented or not. If not, then the controller 12 will typically impose a delay until the ICE further warms up and the requisite valvetrain timing requirements are met.

In step 68, the controller 12 provides commands to the valvetrain controller 18 and/or fuel injection controller 20 as needed to implement the strategy.

It should be noted that the above sequence can be run in parallel if multiple valvetrain dependent strategy are requested during a cold start. In this way, the various options of each strategy are implemented in a staggered fashion as the engine parameters permit.

Finally, in decision step 70, a determination is made if the ICE 14 has reached its warm steady state operational state.

If so in step 72, then any restrictions for implementing any of the above defined valvetrain dependent strategies are typically removed.

Oil Heating and Pumping

In many skip fire controlled engines, a hydraulic valvetrain system using engine oil is used to deactivate the intake and exhaust valves during skipped working cycles. Proper operation of the hydraulic deactivation system depends on there being sufficient oil pressure available to operate the deactivation mechanism. Also, the speed of the deactivation mechanism is dependent on the oil viscosity, which in turn is dependent on oil temperature. As a general rule, as oil pressure and temperature increase, the response time of a hydraulic valvetrain decreases. During a cold start, the oil is generally cold and the initial oil pressure may be low. Therefore, as discussed at length herein, the ability to activate/deactivate intake and exhaust valves following a cold start may be limited.

Referring again to FIG. 1, in alternative embodiments, an optional oil heater control unit 22 and oil pressure control unit 24 may be used in cooperation with the controller 12. For instance during a cold start, the engine controller 12 may issue a command to the oil heater control unit 22 for actively heating the oil and/or to the oil pressure control unit 24 for increasing the oil pressure. In alternative embodiments, other active steps can be taken to prevent the cooling of the oil, thereby allowing the oil to heat up faster following a cold start. For example, the engine oil can temporarily be diverted from any heat-exchanging surface or element following a cold start so that it heats up more quickly. Once the engine reaches its warm operating temperature, the oil can then be cooled as normal.

By taking active steps to heat the engine oil, the engine oil can be rapidly heated faster, and viscosity reduced, faster than just by naturally running the engine. The oil pressure control unit 24, which may be used to control a variable flow/pressure oil pump, can be used either in cooperation with active oil heating or may be used alone. Generally, a valve response time for deactivation/reactivation can be reduced by increasing the oil pressure. The increased oil pressure or flow may only be used in certain engine operating conditions when an improved valve response time is desired.

Various mechanical configurations may be used in the variable flow/pressure oil pump. For example, the variable flow/pressure oil pump may be engine driven with an electrically controlled valve allowing two distinct oil pressure levels at a given engine speed. Alternatively, the oil pump may again be engine driven and may have an electrically controlled valve allowing continuous oil pressure control semi-independent of engine speed. In another embodiment of an engine-driven oil pump, the oil pump may have an electrically controlled geometry (e.g. vane orientation) allowing continuous oil pressure control semi-independent of engine speed. In yet other embodiments, the oil pump may be a two-stage oil pump with an electrical booster pump in series with an engine driven oil pump. The electrical booster pump can be switch on to boost oil pressure as required. In yet other embodiments, the oil pump may be totally electrically driven so that the oil pressure is independent of engine speed and engine operation is not required to pressurize the engine oil.

Various control strategies may be employed with the oil pump. As previously described, increasing the oil pressure to a higher pressure setting may be used in cold starts when the oil temperature is low. This may enable cylinder deactivation/reactivation earlier in the drive cycle compared to operating at a lower oil pressure. The oil pump may temporarily increase the engine oil pressure until the engine oil temperature reaches a threshold value. By having the engine oil at an elevated pressure, at least one of the engine's intake or exhaust valves may be deactivated prior to the engine oil reaching a threshold value. After reaching the threshold value, valve deactivation may be realized without use of elevated oil pressure levels. Increased oil pressure may also be used when operating an engine at high speeds, which requires faster valve switching. The increased oil pressure will enable a faster valve response and allow skip fire operation at higher engine speeds than would otherwise be possible. In some embodiments, dynamic compensation of oil pressure or oil flow may be made during high oil demand conditions. For example, fast cam phaser movements or use of oil jets to cool engine pistons can require high oil flow rates. By controlling an oil pump to operate at higher pressure, these uses for engine oil may be supported. In some cases, the oil pump pressure may be commanded to rise for a short period before an actuator causing the high oil demand is activated. By actively increasing either or both the oil pressure and the oil temperature many of the valvetrain dependent strategies discussed herein can be implemented more aggressively than if no active steps were taken.

Alternative Embodiment

It is noted that although the present invention as described herein is largely described in the context of a skip fire or dynamic skip fire controlled engine, this should be by no means construed as a limitation. On the contrary, the present invention is applicable to any type of engine where some firing opportunities are fired and others are skipped, such as a conventional variable displacement engine in which a first group of one more cylinders is fired and a second group of one or more cylinders are skipped.

Although only a few embodiments have been described in detail, it should be appreciated that the present application may be implemented in many other forms without departing from the spirit or scope of the disclosure provided herein. Therefore, the present embodiments should be considered illustrative and not restrictive and is not to be limited to the details given herein, but may be modified within the scope and equivalents of the appended claims.

What is claimed is:

1. An engine controller configured to control operation of a variable displacement internal combustion engine (ICE) having a plurality of cylinders, the engine controller configured to:

predict a number of upcoming successive skipped working cycles for a select cylinder of the ICE;

operate the select cylinder as an Air Spring (AS) in at least a first skipped working cycle among the number of predicted upcoming successive skipped working cycles; and selectively command a re-exhaust or re-intake of the select cylinder during a last skipped working cycle among the predicted number of upcoming successive skipped working cycles.

2. The engine controller of claim 1, wherein if the predicted number of upcoming successive skipped working cycles for the select cylinder is one, then the select cylinder is commanded to implement an Air Spring (AS) in the first skipped working cycle without the re-exhaust or re-intake.

3. The engine controller of claim 1, wherein if the predicted number of upcoming successive skipped working cycles for the select cylinder is within a predetermined numerical range of skips, then the select cylinder is commanded to implement:

an AS in all the successive skipped working cycles but the last skipped working cycle; and a Low-Pressure Exhaust Spring (LPES) with re-exhaust in the last skipped working cycle.

4. The engine controller of claim 1, wherein if the predicted number of upcoming successive skipped working cycles for the select cylinder is more than a predetermined number of skips, then the select cylinder is commanded to implement an AS in all the successive skipped working cycles, but with no re-exhaust in the last skipped working cycle.

5. The engine controller of claim 4, further configured to command a re-intake for the select cylinder for a subsequent fired working cycle immediately following the last skipped working cycle.

6. The engine controller of claim 1, further configured to command a re-intake during at least some skipped working cycles of the plurality of cylinders.

7. The engine controller of claim 1, further configured to command a re-exhaust during at least some skipped working cycles of the plurality of cylinders.

8. The engine controller of claim 1, wherein the controller is further configured to selectively command the plurality of cylinders to implement one of a plurality of pneumatic springs, the plurality of pneumatic springs including, in addition to the AS pneumatic spring, a Low-Pressure Exhaust Spring (LPES), and a High-Pressure Exhaust Spring (HPES).

9. The engine controller of claim 8, further configured to selectively command the plurality of cylinders to implement one of the plurality of pneumatic springs at least partially based on a combination of:

(a) a speed of the ICE; and (b) the predicted number of upcoming successive skipped working cycles for each of the plurality of cylinders respectively.

10. The engine controller of claim 8, further configured to selectively command the plurality of cylinders to implement one of the plurality of pneumatic springs at least partially based on a combination of:

(a) a torque load demanded of the ICE; and (b) the predicted number of upcoming successive skipped working cycles for each of the plurality of cylinders respectively.

11. The engine controller of claim 8, further configured to:

operate the ICE at a first firing fraction;

define a second firing fraction for operating the ICE, the second firing fraction sufficient to meet a requested torque demand; and command cylinders during the skipped working cycles to implement one of the several pneumatic springs, the several pneumatic springs including AS, LPES and HPES, wherein the pneumatic spring each of the cylinders is commanded to implement during each skipped working cycle is at least partially based on the number of successive skipped working cycles for each of the cylinders during the transition respectively.

12. The engine controller of claim 1, further configured to operate the ICE as one of the following:

(a) a variable displacement ICE where a first group of cylinders are successively fired, and a second group of cylinders are successively skipped so long as the internal combustion engine is operating at a same reduced effective displacement;

(b) a skip fire-controlled ICE in which at least one cylinder is fired, skipped and either fired or skipped over three successive firing opportunities while the ICE is operating at a firing fraction that is less than one (1); or (c) a dynamic skip fire-controlled ICE in which a decision to either fire or skip each cylinder is made on a firing opportunity by firing opportunity basis or an engine cycle-by-engine cycle basis.

13. A controller configured to control operation of a variable displacement internal combustion engine (ICE) comprising predicting a number of successive skips for a plurality of cylinders of the ICE during operation and commanding those cylinders to implement an Air Spring (AS) for one or more first successive skips and a Low-Pressure Exhaust Spring (LPES) with re-exhaust for a last skip when the predicted number of successive skips is two (2) or more respectively.

14. A controller configured to control operation of a variable displacement internal combustion engine (ICE) comprising predicting a number of successive skips for a plurality of cylinders of the ICE during operation and commanding those cylinders to implement an Air Spring (AS) for one or more first successive skips and an AS with no re-exhaust for a last skip when the predicted number of successive skips is two (2) or more respectively.

15. A controller configured to control operation of a variable displacement internal combustion engine (ICE) comprising predicting a number of successive skips for a plurality of cylinders of the ICE during operation and commanding those cylinders to implement a Low-Pressure Exhaust Spring (LPES) for one or more first successive skips and an Air Spring (AS) for a last skip when the predicted number of successive skips is two (2) or more respectively.

16. An engine controller configured to:

cold start an internal combustion engine (ICE); and following the cold start:

operate the ICE such that some firing opportunities of cylinders are fired while other firing opportunities of the cylinders are skipped;

staggering enablement of different firing fractions as the ICE warms so that some firing fractions having relaxed valvetrain timing requirement are enabled before other firing fractions having more stringent valvetrain timing requirements; and stagger enablement of different pneumatic springs for skipped firing opportunities of cylinders as the ICE warms based on valvetrain timing requirements respectively.

17. The engine controller of claim 16, wherein Air Springs (AS) and High-Pressure Exhaust Springs (HPES) pneumatic springs are enabled before Low-Pressure Exhaust Springs (LPES) pneumatic springs.

18. The engine controller of claim 16, further configured to stagger enablement of different cylinder reactivations events following the cold start as the ICE warms based on valvetrain timing requirements.

19. The engine controller of claim 16, further configured to stagger enablement of different cylinder recharging events following the cold start as the ICE warms based on valvetrain timing requirements.

* * * * *